US006862418B2

(12) United States Patent
Morita et al.

(10) Patent No.: US 6,862,418 B2
(45) Date of Patent: Mar. 1, 2005

(54) COLOR IMAGE FORMING APPARATUS

(75) Inventors: Kazushige Morita, Nara (JP); Yuriko Shindoh, Yamatokoriyama (JP); Hiroko Ishibashi, Ikoma (JP); Yoshihide Shimoda, Nara (JP); Masanori Matsumoto, Kashihara (JP)

(73) Assignee: Sharp Kabushiki Kaisha, Osaka (JP)

( * ) Notice: Subject to any disclaimer, the term of this patent is extended or adjusted under 35 U.S.C. 154(b) by 5 days.

(21) Appl. No.: 10/387,537

(22) Filed: Mar. 14, 2003

(65) Prior Publication Data

US 2003/0206754 A1 Nov. 6, 2003

(30) Foreign Application Priority Data

Mar. 15, 2002 (JP) ..... 2002-072179

(51) Int. Cl.[7] ..... G03G 15/01
(52) U.S. Cl. ..... 399/223; 399/299; 430/46
(58) Field of Search ..... 430/46; 399/299, 399/223, 303

(56) References Cited

U.S. PATENT DOCUMENTS 5,202,727 A * 4/1993 Izumizaki et al. ..... 399/82
6,403,270 B2 * 6/2002 Itami et al. ..... 430/59.5

FOREIGN PATENT DOCUMENTS

JP 11-024358 A 1/1999
JP 11-052599 A 2/1999
JP 10-333393 A 12/1999
JP 2000-242056 A 9/2000
JP 2000-242057 A 9/2000
JP 2000-330303 A 11/2000
JP 2001-051467 A 2/2001
JP 2001-249576 A 9/2001

* cited by examiner

*Primary Examiner*—John L Goodrow
(74) *Attorney, Agent, or Firm*—Birch, Stewart, Kolasch & Birch, LLP

(57) ABSTRACT

An electrophotographic color image forming apparatus including a multiple number of photoreceptors for multiple development colors including black, is constructed such that the photoreceptors satisfy the following relation:

$$0.5<(X/Y)<0.8,$$

where X represents the reduction in film thickness (Å) per $1\times10^7$ mm of the traveling distance of the photoreceptor for black development and Y represents the reduction in film thickness (Å) per $1\times10^7$ mm of the traveling distance of the photoreceptors for the other development colors. This limitation is aimed at differentiating the abrasion resistance of the photoreceptors between that for black and that for colors and designating the reduced amounts of the film thickness per unit traveling distance to fall within the predetermined ranges, whereby it is possible to prevent the drum for black development, which is used most frequently, alone, from being worn away at an earlier time. Accordingly, both the drums for black and for colors can be replaced at approximately the same time, to the maintenance cost can be reduced.

12 Claims, 3 Drawing Sheets

COLOR IMAGE FORMING APPARATUS

BACKGROUND OF THE INVENTION (1) Field of the Invention

The present invention relates to a color image forming apparatus such as a color printer, etc., and relates to a so-called tandem type color image forming apparatus wherein a multiple number of photoreceptors are charged so as to develop color images by developing devices holding different color toners.

(2) Description of the Prior Art

Recently, in the field of color electrophotographic processing, tandem type color image forming apparatuses in which a multiple number of photoreceptor drums for multiple colors of toner are arranged in line to obtain a color image have been used in order to enhance the printing speed. This tandem type configuration lends itself to color image forming apparatuses and multi-color image forming apparatuses for outputting image formed articles of reproduction and composition of color images and multi-color images by successively transferring a plurality of color separation images for color image data or multi-color image data, in a layered manner, as well as image forming apparatuses including a color image forming function or multi-color image forming function. It is essential for these image forming apparatuses that all the photoreceptors arranged therein should always have the same level of quality in order to provide images without color imbalance between the color components.

Even if uniform images free from unevenness can be obtained when all the photoreceptors are unused, the problem may take place that the image quality becomes degraded as the photoreceptors are worn down as they are used. Despite of its name, a color image forming apparatus in practice is often used for monochrome (black/white) printing other than color printing. There are cases where monochrome printing is implemented more often than color printing, hence there is a drawback that the photoreceptor for black images becomes worn away earlier than the other color photoreceptors.

Usually, the processing system is designed so that the four photoreceptors for the four colors Y, M, C and K(Bk) toners will not present inharmonious wear characteristics. If, however, the photoreceptors for individual toners are worn away in different manners, there occurs color unevenness and color imbalance as the number of copies increases. In such cases, all the drums, instead of the drum which, alone, has been heavily degraded, should be replaced. Particularly, if hard papers such as post cards are used, large wear takes place locally, causing large influences.

Further, when contact type chargers which will impose heavier burdens on the photoreceptors are used, the amounts of wear of the drums become large. If the wear of the photoreceptor is made small and uniform, it is possible to make the interval for replacement of the drum longer. Further, if all the drums reach the end of their life at almost the same time, concurrent replacement of all the drums will never produce any loss. However, if the wear and degradation rates of the drums differ between different colors of developing devices, degradation of only one of them requires replacement of all the drums. Otherwise, color imbalance between the new drum and the other drums, which have not been replaced, takes place, resulting in failure to obtain good image quality. In other words, the interval of drum replacement is determined by the most intensively degraded drum among the four. This results in being wasteful and uneconomical.

As countermeasures, Japanese Patent Application Laid-open Hei 10 No.333393, Japanese Patent Application Laid-open Hei 11 No.24358 and Japanese Patent Application Laid-open Hei 11 No. 52599, disclose configurations in which an α-Si or α-SiC photoreceptor is used for that for black development so as to enhance the photoreceptor life while OPCs (organic photoreceptors) are used for those other than that for black development. There is, however, a problem that α-Si and α-SiC photoreceptors used in the above publications are less chargeable. As a solution to this drawback, Japanese Patent Application Laid-open Hei 10 No.333393 specifies the thickness of the photoreceptor to be 30 μm or more and its difference in surface potential from the other organic photoreceptors to be equal to or lower than 200 V. Japanese Patent Application Laid-open Hei 11 No.24358 proposes that the applied voltage to the α-Si photoreceptor should be 1.05 to 2.50 times the application voltage to the organic photoreceptors. Further, Japanese Patent Application Laid-open Hei 11 No.52599 is aimed at increasing the chargeability by adding an α-SiC surface layer.

In the above way, in order to extend the life of the photoreceptor for black development while making up for the low chargeability of the α-Si or α-SiC photoreceptor, it is necessary to make complicated charge control for black development, resulting in the need of extra cost. Further, since, other than the charge control, there are differences in light sensitivity and susceptivity to temperature/humidity, between the α-Si or α-SiC photoreceptor and the organic photoreceptor, light exposure, transfer conditions and other factors differ between the α-Si or α-SiC photoreceptor for black development and the organic photoreceptors for development other than black. Therefore, a different control method of the photoreceptor for black development from that for the photoreceptors for the other colors should be used, thus again resulting in the need of extra cost. The α-Si or α-SiC photoreceptors disclosed in Japanese Patent Application Laid-open Hei 10 No.333393, Japanese Patent Application Laid-open Hei 11 No.24358 and Japanese Patent Application Laid-open Hei 11 No.52599, have the problem that their production cost is obviously high compared to the organic photoreceptors. Further, as another problem, they consume large amounts of black toner, as is well known.

As the countermeasures against the above problems, Japanese Patent Application Laid-open 2000 Nos.242056 and 242057 propose configurations where the drum for black development alone is increased in diameter or increased in film thickness. Japanese Patent Application Laid-open 2001 No.51467 refers to use of a non-contact type charging means only for black development, increase in film thickness and use of a resin having a large viscosity-average molecular weight. Further Japanese Patent Application Laid-open 2000 No.330303 discloses a polycarbonate copolymer resin as the resin for tandem photoreceptors. Further, provision of a protective layer on only the photoreceptor for black development has been also investigated as an optional method.

Increase of the drum diameter for black development alone as in Japanese Patent Application Laid-open 2000 Nos.242056 and 242057 results in enlargement of the machine body. Increase in thickness of the coating film may cause reduction in the amount of charge or degrade dot reproducibility and/or line reproducibility in the image. Further, use of a resin having a large viscosity-average molecular weight produces an air entrapment problem when it is applied and causes difficulties in application. Japanese Patent Application Laid-open 2000 No.330303 also discloses use of various copolymer polycarbonate resins as the resin for tandem photoreceptors and refers to the relationship between the maximum/minimum abrasion losses. However, the discussed photoreceptors for black and other color development use an identical configuration, hence it is impossible to lengthen the life of the photoreceptor for black development in a general environment in which monochrome copy mode is used often.

On the other hand, Japanese Patent Application Laid-open 2001 No.249576 refers to increase in film thickness of the photoreceptor layer in order to improve the abrasion resistance of the photoreceptive layer of the photoreceptor used in the image forming and transfer unit undergoing a greater contact abrasive force. However, when, for example, a silicon photoreceptor presenting a markedly large abrasion resistance is used for black development only, the photoreceptor for black images, alone, is still usable despite the photoreceptors for colors having already reached the end of their life, bringing about a reversal in the relationship, so this cannot be said to be the perfect solution.

SUMMARY OF THE INVENTION

The present invention is aimed at solving the above conventional problems and attaining the following object. It is therefore an object of the present invention to provide a color image forming apparatus in which all the photoreceptors, even though use frequencies are different across the colors, may have approximately the same life and which is low in maintenance cost.

A color image forming apparatus of the present invention comprises a multiple number of electrophotographic image forming stations for multiple development colors including black, arranged in line in the paper feed direction, each image forming station having a photoreceptor, a charger, an exposure device, a developing device, a transfer device and a cleaning device, and is characterized in that the photoreceptors satisfy the following relation:

$$0.5<(X/Y)<0.8,$$

where X represents the reduction in film thickness (Å) per $1\times10^7$ mm of the traveling distance of the photoreceptor for black development and Y represents the reduction in film thickness (Å) per $1\times10^7$ mm of the traveling distance of the photoreceptors for the other development colors.

In this case, it is possible to lengthen the life of the photoreceptor for black development, which is used most frequently, compared to the life of the photoreceptors used for the other development colors, conforming to the empirically acquired usage frequencies of all the colors. Accordingly, it is possible to prevent the drum for black development, which is used most frequently, alone, from reaching the end of life at an earlier time, so that both the drum for black and the drums for colors can be replaced at approximately the same time.

The present invention is also characterized in that the binder resin used for either the photoreceptor for black development or at least one of the photoreceptors for the other development colors employs a polycarbonate polymer having, at least, one structural unit represented by the following general formula (1):

(1)

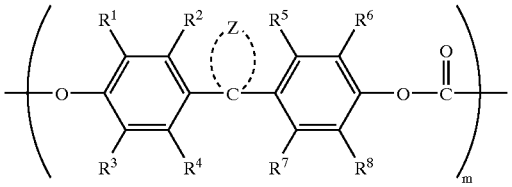

(wherein $R^1$, $R^2$, $R^3$, $R^4$, $R^5$, $R^6$, $R^7$ and $R^8$ individually represent a hydrogen atom, halogen atom, substituted or unsubstituted alkyl of 1 to 6 carbon atoms, $C_{4-C10}$ cyclic hydrocarbon residual group, substituted or unsubstituted aryl, and Z represents a group of atoms required to constitute a substituted or unsubstituted cycle or substituted or unsubstituted hetero-cycle, m being an integer).

Accordingly, when the present invention is realized, it is possible to improve and control the image stability against ozone, NOx and the like and enhance the plate wear.

The present invention is also characterized in that the binder resin used for either the photoreceptor for black development or the photoreceptors for the other development colors employs a polycarbonate polymer having, at least, one structural unit represented by the general formula (1).

Accordingly, when the present invention is realized, it is possible to improve the image stability against ozone, NOx and the like and enhance the plate wear.

The image forming apparatus of the present invention is also characterized in that the photoreceptors other than that for black development are stopped operating in monochrome (black and white) copy mode.

Accordingly, rotation of the unnecessary photoreceptors can be obviated so that it is possible to reduce the film abrasion of the photoreceptors other than that for black development.

The image forming apparatus of the present invention is further characterized in that the photoreceptors other than that for black development are separated from the recording media conveyer belt, in monochrome (black and white) copy mode.

Accordingly, since the photoreceptors other than that for black development are separated from the recording media conveyer belt, in monochrome (black and white) copy mode, it is possible to avoid the chance of the coating films of the photoreceptors being abraded by recording media and/or the recording media conveyer belt or the like, hence lengthen the life of the photoreceptors.

The image forming apparatus of the present invention is characterized in that the film thickness of the photoreceptor layer ranges from 18 $\mu$m to 27 $\mu$m.

In this case, it is possible to produce good images without any loss of dot reproducibility or line reproducibility in the images.

As to the shape and/or appearance of the photoreceptors or their parts in the image forming apparatus, the shape and/or appearance of the photoreceptor for black development or its part is made different from the shape and/or appearance of the photoreceptors or their parts for the other development colors.

There are cases where the photoreceptors of different colors cannot be differentiated only from their appearances. Designing them so as to be incompatible to each other obviates misplacement of the photoreceptors into the wrong places, hence intended result can be positively be achieved.

DESCRIPTION OF THE PREFERRED EMBODIMENTS

The embodiment of the present invention will hereinafter be described in detail with reference to the accompanying drawings.

Figure 1:
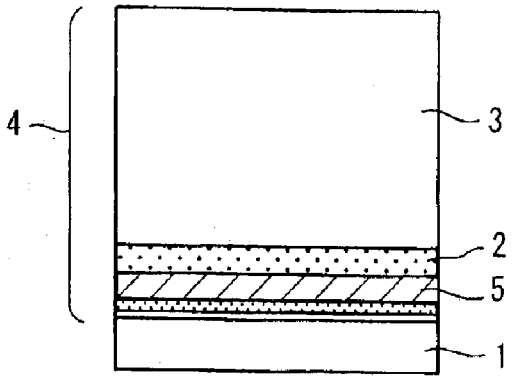
FIG. 1 is a schematic sectional view of a layered photoreceptor according to the embodiment of the present invention.

To begin with, the constituent materials in the schematic sectional view of a layered photoreceptor shown in FIG. 1 as one embodiment of the photoreceptor of the present invention will be described. In FIG. 1, 1 designates a conductive substrate, 2 a charge generation layer, 3 a charge transport layer, 4 a photosensitive layer of the photoreceptor consisting of an undercoat layer, charge generation layer and charge transport layer, and 5 an undercoat layer provided between the conductive substrate and the charge generation layer.

As conductive substrate 1, metals such as aluminum, copper, brass, zinc, nickel, stainless steel, chromium, molybdenum, vanadium, indium, titanium, gold and platinum and alloys of these can be used. Other than these, polyester film, paper and metal film on which aluminum, aluminum alloy, tin oxide, gold, indium oxide or the like is deposited or applied, plastic and paper containing conductive particles, and plastics containing conductive polymers or the like can be used. These materials are shaped and used in a cylindrical, columnar form or in a film sheet form.

Undercoat layer (intermediate layer) 5 may be provided between conductive substrate 1 and charge generation layer 2. As the undercoat layer 5, an inorganic layer such as an anodic oxide thin film formed on aluminum, aluminum oxide, aluminum hydroxide and the like, an organic layer such as polyvinyl alcohol, casein, polyvinyl pyrolidone, polyacrylic acid, celluloses, gelatin, starch, polyurethane, polyimide, polyamide and the like and an organic layer containing as inorganic pigments, conductive or semi-conductive particles, of metal such as aluminum, copper, tin, zinc, titanium or the like or of metal oxide such as zinc oxide, aluminum oxide, titanium oxide or the like, can be used. As to crystalline types of titanium oxide, there are various types such as the anatase form, rutile form and amorphous type, and any of these can be used alone or in combination. Titanium oxide particles covered with $Al_2O_3$, $ZrO_2$ or the like or a combination of these can be preferably used.

As the binder resin contained in undercoat layer 5, polyvinyl alcohol, casein, polyvinyl pyrolidone, polyacrylic acid, celluloses, gelatin, starch, polyurethane, polyimide, polyamide and other resins can be used. Among these, polyimide resin is preferably used. This is because the binder resin of the undercoat layer is demanded to be insoluble and non-swelling in the solvent used for forming the photoconductive layers over undercoat layer 5, and to present excellent adhesiveness to conductive substrate 1 and enough flexibility. Among polyimide resins, alcohol-soluble nylon resins can be more preferably used. Specific examples of the resin include so-called copolymer nylons having 6-nylon, 66-nylon, 610-nylon, 11-nylon, 12-nylon and others compolymerized, and chemically modified nylons such as N-alkoxymethyl denatured nylon.

In the present invention, general solvents can be used as the organic solvent for the application liquid of undercoat layer 5, but it is preferred that, when alcohol-soluble nylon resin, which is more preferable, is used as the binder resin, a pure or mixture type organic solvent selected from the lower alcohol group having 1 to 4 carbon atoms and another group of organic solvents including dichloromethane, chloroform, 1,2-dichloroethane, 1,2-dichloropropane, toluene, tetrahydrofuran and 1,3-dioxolane be preferably used. In this case, mixing the pure alcohol solvent with the above organic solvent improves dispersibility of titanium oxide in the solvent compared to that in the pure alcohol solvent, so that it is possible to make the stability under storage long-lasting and reuse the application liquid. This also prevents coating defects and uneven coating of undercoating layer 5 when the conductive substrate is dip coated in the application liquid for undercoat layers to form undercoat layer 5, whereby it is possible to achieve uniform application of the photoconductive layer thereon, which leads to provision of an electrophotographic photoreceptor excellent in imaging characteristics and free from film defects.

Production of undercoat layer 5 can be carried out using an undercoat layer application liquid that has been prepared by blending the above inorganic pigment with a solvent and binder resin and dispersing the mixture by means of a ball mill, Dyno-mill, supersonic oscillator or other dispersing machines. For a sheet-like substrate, a baker applicator, bar coater, casting, spin coating or other methods can be used. For a drum substrate, a spray method, vertical ring method, dip coating or other methods can be used.

Charge generation layer 2 is mainly composed of a charge generating material which generates electric charges by illumination of light, and contains publicly known binder, plasticizer and sensitizer, as necessary. Examples of the charge generation material include: perylene pigments such as peryleneimide, perylenic anhydride; polycyclic quinone pigments such as quinacridone, anthraquinone; phthalocyanine pigments such as metal and metal-free phthalocyanines, halogenated metal-free phthalocyanine; squarium dyes; azulenium dyes; thiapyrilium dyes; and azo pigments having a carbazole skeleton, styryl stilbene skeleton, triphenylamine skeleton, dibenzothiophene skeleton, oxadiazole skeleton, fluorenone skeleton, bis-stilbene skeleton, distyryl oxadiazole skeleton or distyryl carbazole skeleton.

In particular, metal-free phthalocyanine pigments, oxotitanyl phthalocyanine pigments, bisazo pigments containing a fluoren ring or fluorenone ring, bisazo pigments consisting of aromatic amines and triazo pigments can present especially high charge generation power, so that use of these provides a high sensitive photoreceptor. Further, with concern to oxotitanyl phthalocyanines, a crystalline type which presents a diffraction peak at a Bragg angle ($2\theta \pm 0.2°$) of 27.3° in the X-ray diffraction spectrum can provide a further high sensitivity and so is more preferred.

Production of charge generation layer 2 can be carried out using an application liquid that has been prepared by blending the fine particles of the above charge generation material with an organic solvent and pluverizing and dispersing the particles by means of a ball mill, sand grinder, paint shaker, supersonic dispersing machine or the like. For a sheet-like substrate, a baker applicator, bar coater, casting, spin coating or other methods can be used. For a drum substrate, a spray method, vertical ring method, dip coating or other methods can be used.

In order to enhance the binding property, binder resins as follows may be added, for example: polyester resin, polyvinyl acetate, polyacrylic ester, polycarbonate, polyacrylate, polyvinyl acetoacetal, polyvinyl propynal, polyvinyl butyral, phenoxy resin, epoxy resin, urethane resin, melamineresin, siliconeresin, acrylicresin, celluloseester, cellulose ether, vinylchloride-vinyl acetate copolymer resin. The film thickness is preferably 0.05 to 5 $\mu$m, more preferably 0.1 to 1 $\mu$m. The charge generation layer may contain various additives such as a leveling agent for improving application performance, antioxidant and sensitizer, as required.

Charge transport layer 3 provided over charge generation layer 2 essentially consists of a charge transport material for accepting charges generated within the charge generation material, and transporting them, and a binder (binder resin). As the charge transport material, the following electron donative materials can be used: poly-N-vinyl carbazole and its derivatives, poly-g-carbazolyl ethylglutamate and its derivatives, pyrene-formaldehyde condensate and its derivatives, polyvinyl pyrene, polyvinyl phenanthrene, oxazole derivatives, oxadiazole derivatives, imidazole derivatives, 9-(p-diethylamine styryl) anthracene, 1,1-bis (4-dibenzyl aminophenyl) propane, styryl anthracene, styryl pyrazoline, pyrazoline derivatives, phenylhydrazones, hydrazone derivatives, triphenylamine compounds, tetraphenyl diamine compounds, triphenylmethane compounds, stilbene compounds, azine compounds having a 3-methyl-2-benzothiazoline ring, etc.

Alternatively, the following electron acceptable substances can be used: fluorenone derivatives, dibenzothiophene derivatives, indeno thiophene derivatives, phenanthrene quinone derivatives, indeno pyridine derivatives, thioxanthone derivatives, benzo[c]cinnoline derivatives, phenazine oxide derivatives, tetracyanoethylene, tetracyanoquinodimethane, bromanil, chloranil, benzoquinone, etc. Of these, particular types of butadiene compounds, styryl compounds and amine compounds, having the following structure are more preferable in the present invention since they show high hole transporting properties so that a high sensitivity can be maintained even when the resin ratio is high. One example is shown below.

(2)

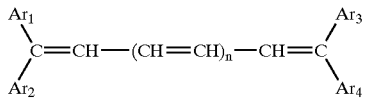

(wherein $Ar_1$, $Ar_2$, $Ar_3$ and $Ar_4$ each represent an aryl which may have a substituent, at least one of $Ar_1$ to $Ar_r$ being an aryl having an amino-substituent as its substituent and n being 0 or 1.)

As the specific examples of the general formula (2), the following compounds (2-1) to (2-12) can be mentioned.

(2-1)

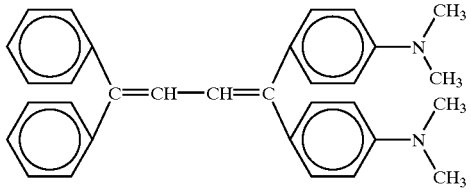

(2-2)

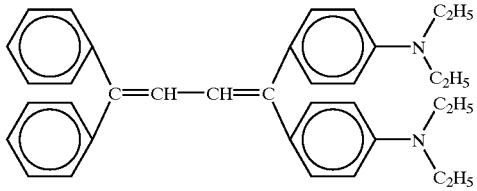

(2-3)

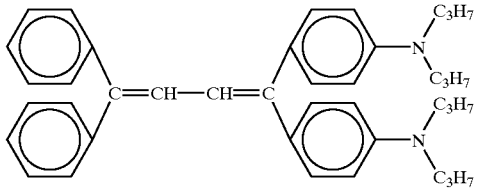

-continued (2-4)

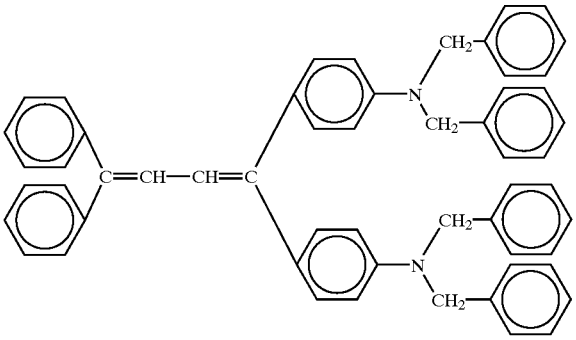

(2-5)

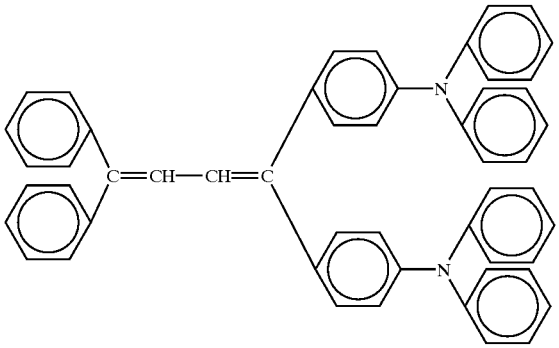

(2-6)

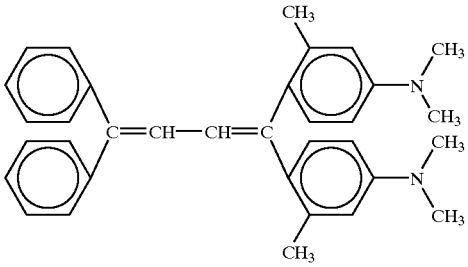

(2-7)

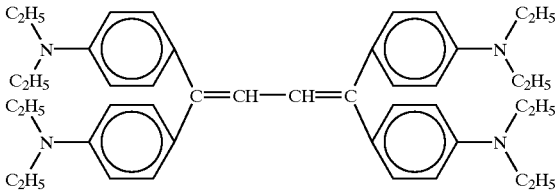

-continued (2-8)

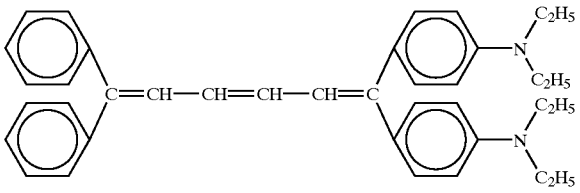

(2-9)

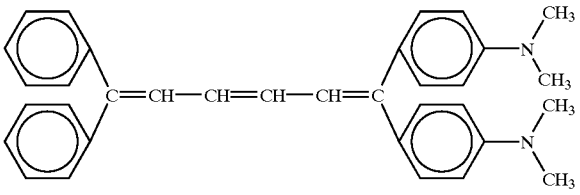

(2-10)

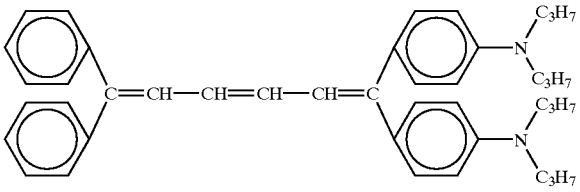

(2-11)

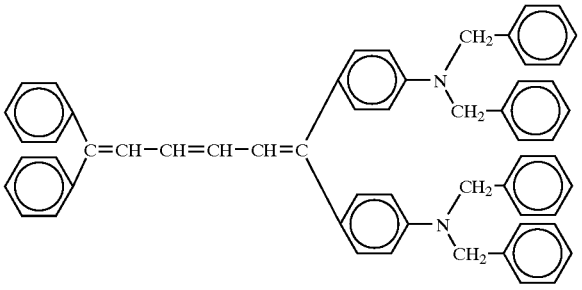

(2-12)

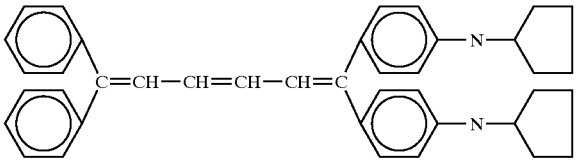

As styryl compounds, the compounds having the following general form (3) can be mentioned.

(3)

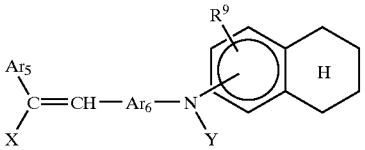

(wherein $Ar_5$ represents an aryl which may have a substituent, $Ar_6$ represents a phenylene, naphthylene, biphenylene or anthrylene which may have a substituent, $R^9$ represents a hydrogen atom or lower alkyl or lower alkoxyl, X represents a hydrogen atom or an alkyl which may have a substituent, or an aryl which may have a substituent, and Y represents an aryl which may have a substituent).

As the specific examples of the general formula (3), the following compounds (3-1) to (3-16) can be mentioned.

(3-1)

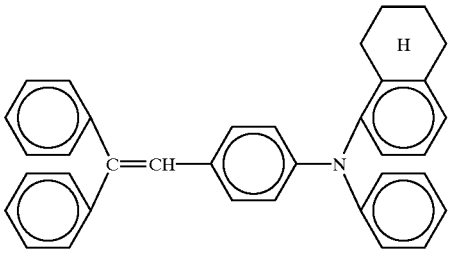

(3-2)

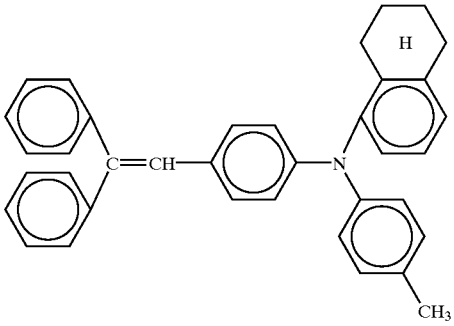

(3-3)

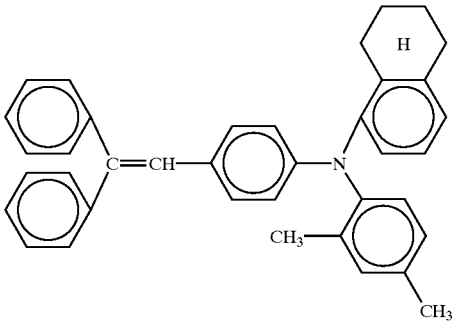

(3-4)

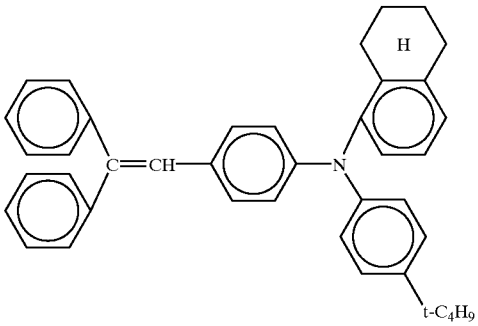

(3-5)

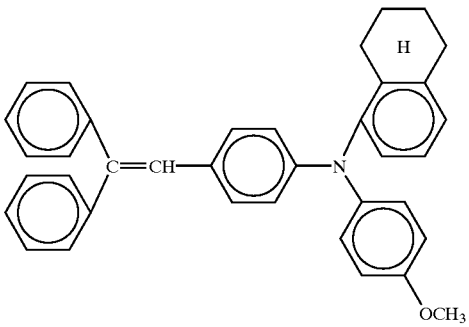

-continued
(3-6)
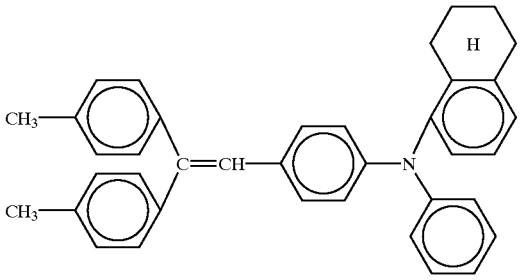
(3-7)
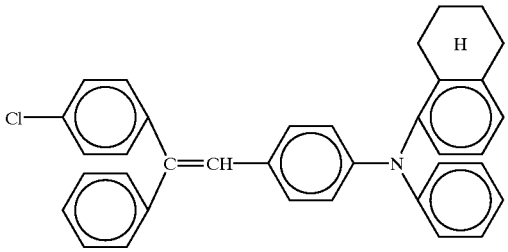
(3-8)
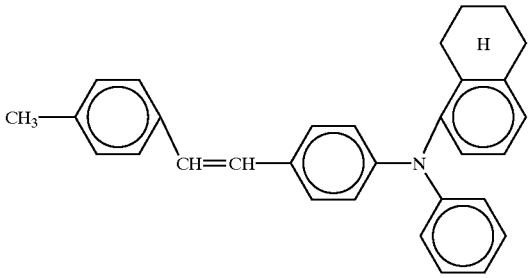
(3-9)
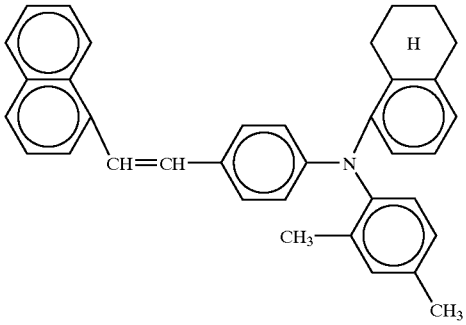
(3-10)
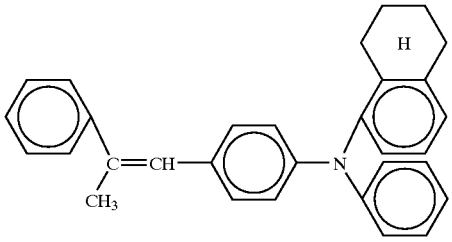
-continued
(3-11)
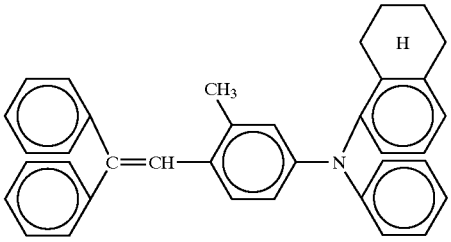
(3-12)
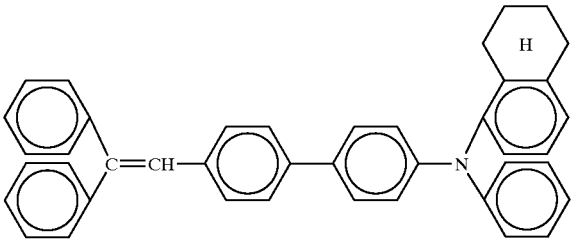
(3-13)
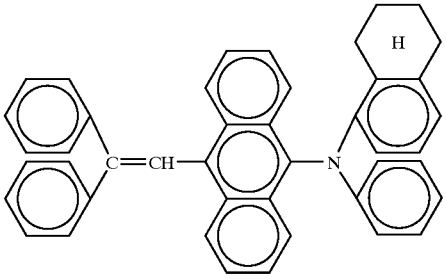
(3-14)
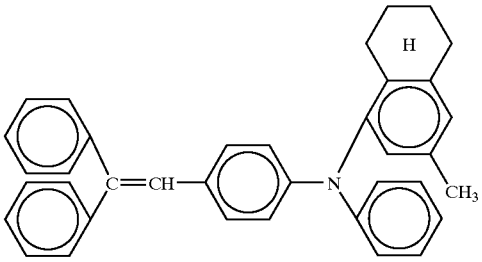
(3-15)
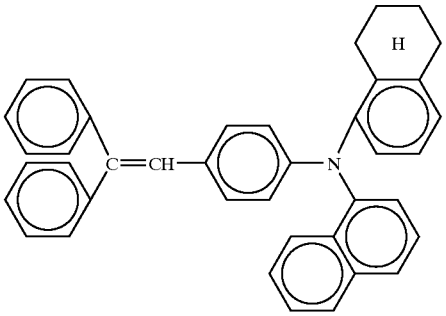

-continued (3-16)

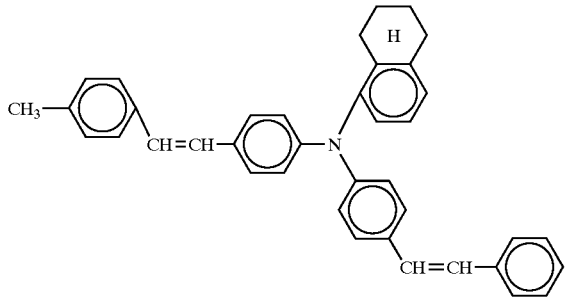

As amine compounds, the compounds having the following general formula (4) can be mentioned.

(4)

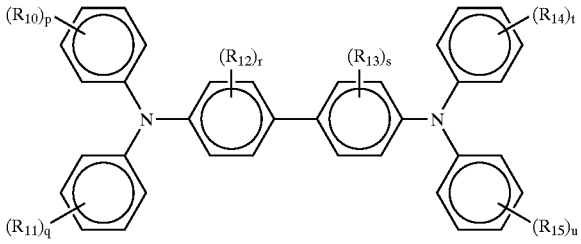

(wherein $R_{10}$ to $R_{15}$ each represent a hydrogen atom, halogen atom, alkyl, alkoxyl, p, q, r, s, t and u indicating an integer 1 to 5).

As specific examples of the general formula (4), the following compounds (4-1) to (4-6) can be mentioned.

(4-1)

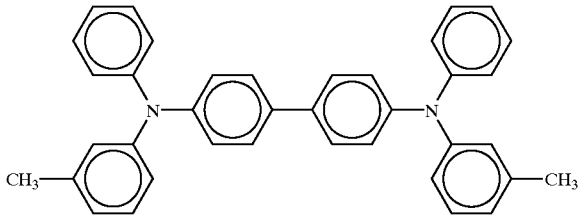

(4-2)

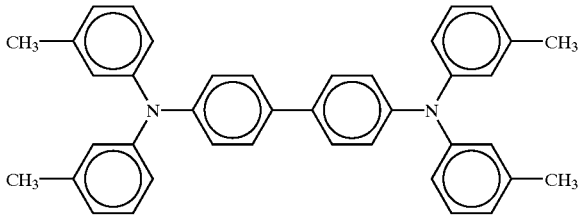

(4-3)

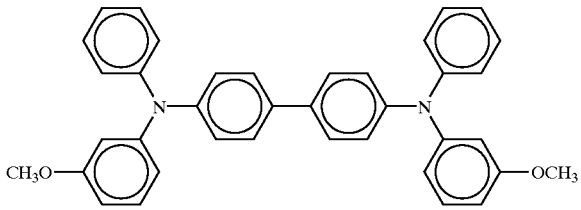

-continued (4-4)

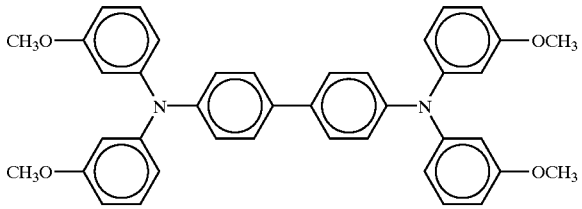

(4-5)

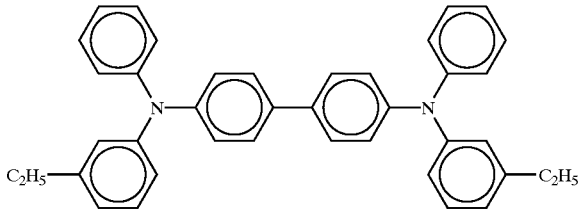

(4-6)

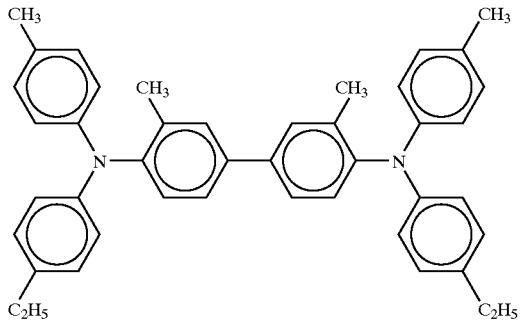

Generally, the binder resin is selected from those which are compatible with the charge transport material. Examples include vinyl polymers such as polymethylmethacrylate, polystyrene and polyvinyl chloride, polycarbonate resin, polyester resin, polyester carbonate resin, polysulfone resin, phenoxyresin, epoxyresin, silicone resin, polyacrylateresin, polyimide resin, polyurethane resin, polyacrylamide resin and phenol resin.

These resins can be used alone or in combination, or may be partially cross-linked so to present thermosetting properties. In particular, polystyrene, polycarbonate, polyacrylate and polyphenylene oxide resins have a volume resistivity of $10^{13}$ Ω or greater and are excellent in coating performance and electric characteristics.

As the binder resin used here, polycarbonate polymers having repeat units of the following general form (5) are preferably used.

(5)

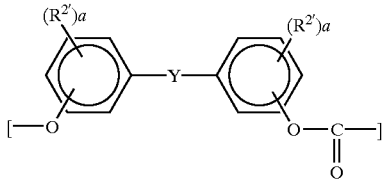

(wherein each $R^{2'}$ individually represents a halogen atom, vinyl, allyl, substituted or unsubstituted alkyl of 1 to 10 carbon atoms, substituted or unsubstituted aryl of 6 to 12 carbon atoms, substituted or unsubstituted cycloalkyl of 3 to 12 carbon atoms, substituted or unsubstituted alkoxyl of 1 to 6 carbon atoms, or substituted or unsubstituted aryloxyl of 6 to 12 carbon atoms, 'a' being an independent integer of 0 to 4, Y representing single bond, —O—, —CO—, —S—, —SO—, $SO_2$—, —$CR^{3'}R^{4'}$—, substituted or unsubstituted cycloalkylidene of 5 to 11 carbon atoms, substituted or unsubstituted a, ω-alkylene of 2 to 12 carbon atoms, 9,9-fluorenylidene, 1,8-menthane diyl, 2,8-menthane diyl, substituted or unsubstituted pyrazilidene, or substituted or unsubstituted arylene of 6 to 24 carbon atoms. Here, $R^{3'}$ and $R^{4'}$ individually represent a hydrogen atom, or substituted or unsubstituted alkyl of 1 to 10 carbon atoms, or substituted or unsubstituted aryl of 6 to 12 carbon atoms.)

The polycarbonate polymer used in the present invention may have one or more types of repeat units having the general form (5). Further, the polycarbonate polymer may contain repeat units other than that having the general form (5), as long as no obstruction to the achievement of the object of the present invention occurs.

In the general representation (5), specific examples of $R^{2'}$, Y, $R^{3'}$ and $R^{4'}$ are as follows.

Examples of a halogen atom represented by $R^{2'}$ include fluorine, chlorine, bromine and iodine. Of these, fluorine, chlorine and bromine are preferred.

Examples of the unsubstituted alkyl of 1 to 10 carbon atoms, represented by $R^{2'}$, $R^{3'}$ and $R^{4'}$, include methyl, ethyl, propyl, isopropyl, butyl, 2-butyl, tert-butyl, isobutyl, pentyl, hexyl, heptyl, octyl, nonyl and decyl. Of these, methyl, ethyl, propyl, isopropyl, butyl, 2-butyl and tert-butyl are preferred.

Examples of the unsubstituted aryl of 6 to 12 carbon atoms, represented by $R^{2'}$, $R^{3'}$ and $R^{4'}$, include phenyl, naphthyl and biphenylyl, and phenyl is preferred. Examples of the unsubstituted cycloalkyl of 3 to 12 carbon atoms, represented by $R^{2'}$, include cyclopentyl, cyclohexyl and cycloheptyl. Of these cyclopentyl and cyclohexyl are preferred.

Examples of the unsubstituted alkoxyl of 1 to 6 carbon atoms, represented by $R^{2'}$, include methyl oxyl, ethyl oxyl, propyl oxyl, isopropyl oxyl, butyl oxyl, 2-butyl oxyl, tert-butyl oxyl, isobutyl oxyl, pentyl oxyl and hexyl oxyl. Of these, methyl oxyl, ethyl oxyl, propyl oxyl and isopropyl oxyl are preferred.

Examples of the unsubstituted aryloxyl of 6 to 12 carbon atoms, represented by $R^{2'}$, include phenyl oxyl, naphthyl oxyl and biphenylyl oxyl. Of these, phenyl oxyl is preferred. Examples of the unsubstituted arylene of 6 to 24 carbon atoms, represented by Y, include phenylene, naphthylene, biphenylylene, terphenylylene and quaterphenylylene. Of these, phenylene is preferred.

Examples of the unsubstituted cycloalkylidene of 5 to 11 carbon atoms, represented by Y, include cyclopentylidene, cyclohexylidene, cycloheptylidene, cyclooctylidene, cyclononylidene, cyclodecylidene and cycloundecylidene. Of these, cyclohexylidene is preferred.

Examples of the unsubstituted α, ω-alkylene of 2 to 12 carbon atoms, represented by Y, include ethylene, trimethylene, tetramethylene, pentamethylene, hexamethylene, heptamethylene, octamethylene, nonamethylene, decamethylene, undecamethylene and dodecamethylene. Of these, ethylene and trimethylene are preferred. As the 1,8-menthane diyl, represented by Y, 1,8-p-menthane diyl is preferred. As the 2,8-menthane diyl, represented by Y, 2,8-p-menthane diyl is preferred.

The substituted alkyl, substituted aryl, substituted alkoxyl, substituted aryloxyl, substituted cycloalkyl, substituted arylene, substituted α, ω-alkylene, substituted cycloalkylidene and substituted pyraziridene indicate the aforementioned unsubstituted alkyl, unsubstituted aryl, unsubstituted alkoxyl, unsubstituted aryloxyl, unsubstituted cycloalkyl, unsubstituted arylene, unsubstituted α, ω-alkylene, unsubstituted cycloalkylidene and unsubstituted pyraziridene, of which one of hydrogen atoms is substituted by a substituent.

Examples of the substituents of the substituted alkyl and substituted alkoxyl include halogen atoms (fluorine, chlorine, bromine, iodine), aryls of 6 to 12 carbon atoms (phenyl, naphthyl, biphenylyl), alkoxyls of 1 to 4 carbon atoms (methoxy, etoxy, propoxy, isopropoxy, butoxy, sec-butoxy, tert-butoxy, isobutoxy), alkylthiols of 1 to 4 carbon atoms (methylthio, etc.) and arylthiols of 6 to 12 carbon atoms (phenylthio, etc.).

Examples of the substituentional groups of the substituted aryl, substituted aryloxyl and substituted arylene include halogen atoms (fluorine, chlorine, bromine, iodine), alkyls of 1 to 4 carbon atoms (methyl, ethyl, propyl, isopropyl, butyl, sec-butyl, tert-butyl, isobutyl), alkoxyls of 1 to 4 carbon atoms (methoxy, etoxy, propoxy, isopropoxy, butoxy, sec-butoxy, tert-butoxy, isobutoxy), alkylthiols of 1 to 4 carbon atoms (methylthio, etc.) and arylthiols of 6 to 12 carbon atoms (phenylthio, etc.).

Examples of the substituents of the substituted α, ω-alkylene, substituted cycloalkyl, substituted cycloalkylidene and substituted pyraziridene include halogen atoms (fluorine, chlorine, bromine, iodine), alkyls of 1 to 4 carbon atoms (methyl, ethyl, propyl, isopropyl, butyl, sec-butyl, tert-butyl, isobutyl), aryls of 6 to 12 carbon atoms (phenyl, naphthyl, biphenylyl), alkoxyls of 1 to 4 carbon atoms (methoxy, etoxy, propoxy, isopropoxy, butoxy, sec-butoxy, tert-butoxy, isobutoxy), alkylthiols of 1 to 4 carbon atoms (methylthio, etc.) and arylthiols of 6 to 12 carbon atoms (phenylthio, etc.). As a preferred examples of the substituted alkyls of 1 to 10 carbon atoms, substituted by halogen atoms for $R^{2'}$, $R^{3'}$ and $R^{4'}$, trifluoromethyl with the three hydrogen atoms of the methyl substituted with fluorine atoms can be mentioned.

When the polycarbonate polymer having the above general form (5) is used alone, the polymer preferably has a viscosity-average molecular weight of 30,000 to 70,000. When it is less than 30,000, the plate wear is markedly reduced. When greater than 70,000, the solution viscosity increases while the plate wear is improved to some degree, hence it takes long time to mix it with the charge transport material and uneven application of coating tends to occur, resulting in a reduced productivity. Use of a polycarbonate polymer having, at least, one structural unit represented by the following general form (1) is especially preferred.

(1)

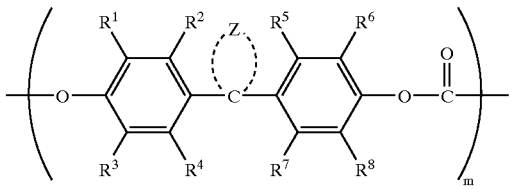

(wherein $R^1$, $R^2$, $R^3$, $R^4$, $R^5$, $R^6$, $R^7$ and $R^8$ individually represent a hydrogen atom, halogen atom, substituted or unsubstituted alkyl of 1 to 6 carbon atoms, $C_4$–$C_{10}$ cyclic hydrocarbon residual group, substituted or unsubstituted aryl. Z represents a group of atoms required to constitute a substituted or unsubstituted cycle or substituted or unsubstituted heterocycle, m being an integer).

As the specific examples of general form (1), the following compounds (1-1) to (1-4) can be mentioned.

(1-1)

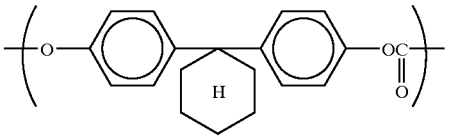

(1-2)

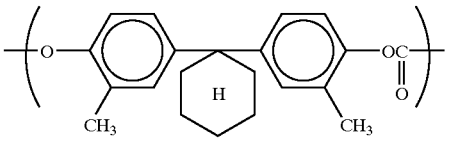

(1-3)

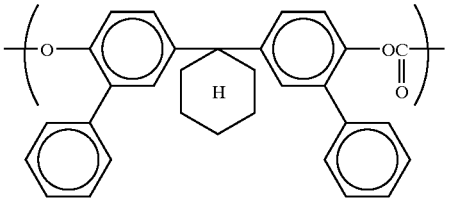

(1-4)

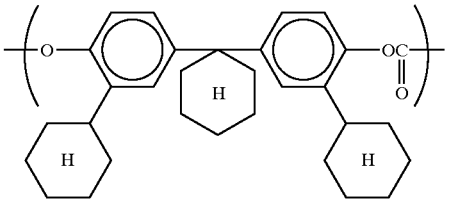

Since the binder resins represented by the above general formula (1) present low permeability to gas, it is possible to prevent infiltration of gases such as ozone, NOx and the like which will degrade photoreceptor characteristics. These resins present excellent compatibility with the charge transport material and also have excellent durability. Blends of these resins also present excellent compatibility with the charge transport material and have excellent durability.

The polycarbonate resin having the above general form (1) preferably has a viscosity-average molecular weight of about 15,000 to 50,000. When it is less than 15,000, while the image stability (image deletion of halftones and occurrence of black stripes) against ozone, NOx, etc., generated by the charging process, improves, lowering of the initial sensitivity, increase in remaining potential when used repeatedly and lowering of the image stability become augmented.

Examples of solvents for dissolving these materials include alcohols such as methanol, ethanol, etc., ketones such as acetone, methylethylketone, cyclohexanone, etc., ethers such as ethylether, tetrahydrofuran, etc., aliphatics such as chloroform, dichloroethane, dichloromethane, etc., halogenated hydrocarbons, aromatics such as benzene, chlorobenzene, toluene, etc.

The ratio between the charge transport material and binder resin is usually set at about 10/15 to 10/6, however, in the present invention, it is preferably set at 10/14 to 10/20, in view of improving abrasion resistance. The application liquid for charge transport layers of the present invention may contain additives such as plasticizer, antioxidant, ultraviolet absorbent, leveling agent and the like, in order to improve film forming performance, flexibility, application performance and the like. When the charge transport substance is contained in a ratio greater than 10/14, good sensitivity is obtained, while the charging characteristics, the mechanical strength of the coating and the image stability (occurrence of image deletion of halftones and black stripes) against ozone, NOx and the like, generated during the charging process, degrade. In contrast, when the binder resin is contained in a ratio greater than 10/20, the charging characteristics, the mechanical strength and the image stability are good while the sensitivity markedly lowers. The charge transport layer is preferably formed with a thickness of 15 to 30 $\mu$m, more preferably 18 to 27 $\mu$m.

In the present invention, the charge transport layer may contain additives such as an antioxidant, leveling agent and the like, together with the above binder resin. As the antioxidant, typical antioxidants which are added to resins can be used as is. For example, vitamin E, hydroquinone, hindered amine, hindered phenol, p-phenylenediamine, arylalkane and their derivatives, organosulfur compounds, organophosphorous compounds and others can be blended. The preferable usage of the antixoidant is 0 to 20 parts by weight relative to 100 parts by weight of the binder resin. As a leveling agent, silicone oils, polymers or origomers having perfluoroalkyl side chains can be used. The proper usage of the leveling agent is 0 to 1 part by weight relative to 100 parts by weight of the binder resin.

The application liquid for charge transport layers can be prepared without any problem by a typical method in which the charge transport substance, binder resin and additives are measured and then dissolved altogether into a predetermined amount of organic solvent. However, it is preferred that the binder resin has been dissolved first into the solvent and then, the carrier transport substance is added and dissolved therein. This method improves dispersibility of the carrier transport substance in the binder resin and inhibits possible and local crystallization of the carrier transport agent in the film, whereby it is possible to improve the initial sensitivity and potential stability after repeated usage and provide good image characteristics and the like. For application, the same method as used for the undercoat layer and charge generation layer can be used. The proper solvent to dissolve (or disperse) the charge transport substance is, in effect, the same as that used for dispersing the charge generation substance, hence can be selected from the solvents listed for the charge generation material. Among those, tetrahydrofuran is especially preferable.

For attachment of the photoreceptors into a copier or printer, rotational mechanisms are needed. Specifically, a drive transmission part called 'flange' is assembled for each photoreceptor. These flanges usually have the same shape and appearance. In the present invention, the photoreceptor for black development and the photoreceptors for the other development colors or their parts (transmission parts such as flanges, etc.,) should be made different in shape and/or appearance. If their shapes are indistinguishable, the flanges can be made different in color so as to obviate misplacement. Since full performance cannot be obtained if the photoreceptors are set in the wrong places, it is preferred that the flange for the photoreceptor for black should be formed with a different shape from that of the other photoreceptors so it will be incompatible with the others.

Figure 2:
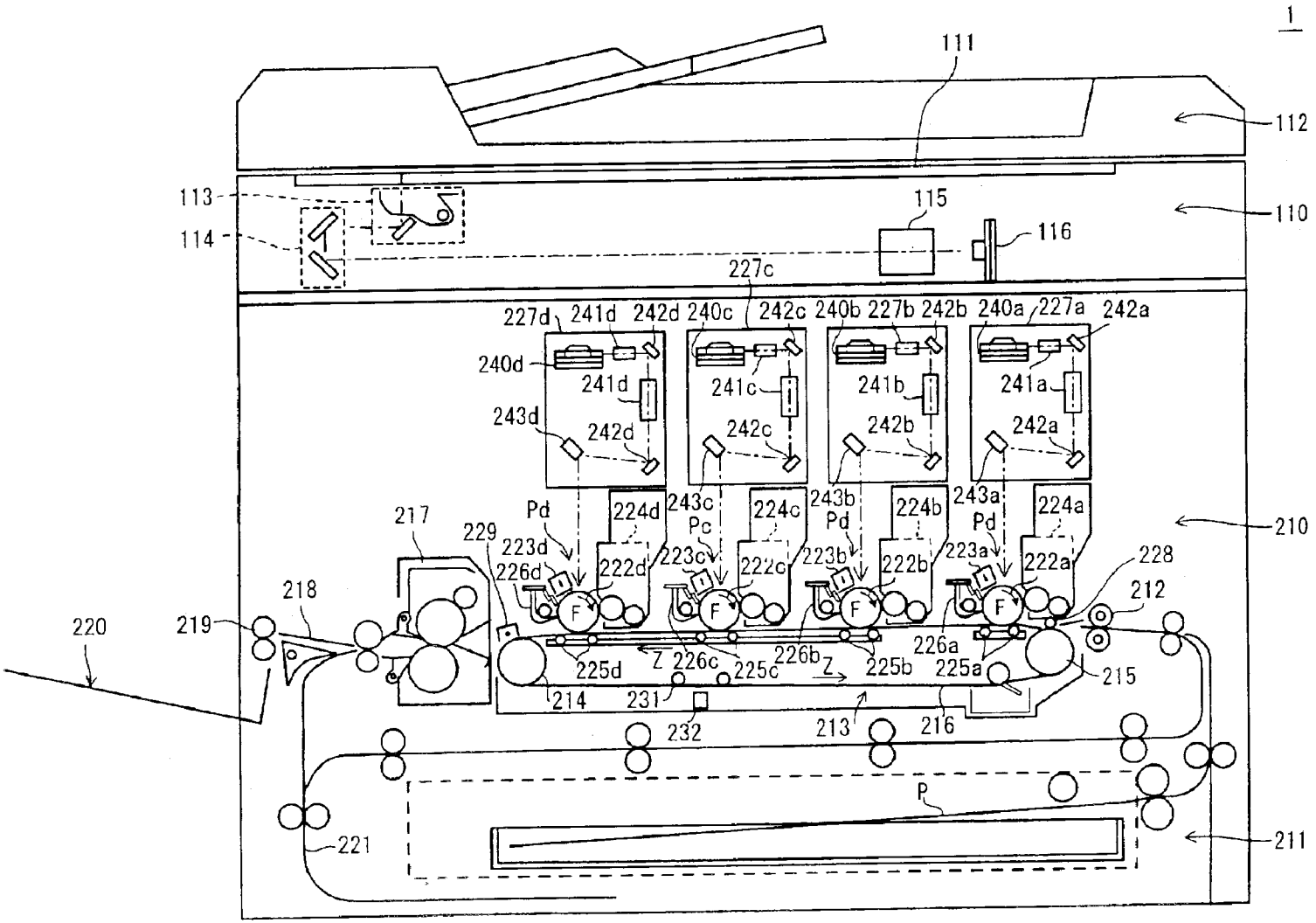
FIG. 2 is a schematic front sectional view showing the configuration of a digital color copier as an image forming apparatus of the present invention.

Next, the image forming apparatus of the present invention will be described with reference to the accompanying drawing. FIG. 2 is a schematic front sectional view showing the configuration of a digital color copier as an image forming apparatus in accordance with the embodiment of the present invention. The copier body 1 has an original table 111 and a control panel on the top thereof and has an image reading portion 110 and an image forming unit 210 within.

A reversing automatic document feeder (RADF) 112 is arranged on the top surface of original table 111 in a predetermined position with reset to the original table 111 surface whilst being supported so as to be opened and closed relative to original table 111.

RADF 112, first, conveys an original so that one side of the original opposes image reading portion 110 at the predetermined position on original table 111. After the image scanning of this side is completed, the original is inverted and conveyed to original table 111 so that the other side opposes image reading portion 110 at the predetermined position on original table 111. Then, when RADF 112 completes image scanning of both sides of one original, the original is discharged and the duplex copy conveying operation for a next document is implemented. The operation of the conveyance and face inversion of the original is controlled in association with the whole copier operation.

Image reading portion 110 is disposed below original table 111 in order to read the image of the original conveyed onto original table 111 by means of RADF 112. Image reading portion 110 includes original scanning portion 113 and 114 which reciprocates along, and in parallel to, the undersurface of original table 111, an optical lens 115 and a CCD line sensor 116 as a photoelectric converting device. This original scanning portion 113 and 114 is composed of first and second scanner units 113 and 114. First scanner unit 113 has an exposure lamp for illuminating the original image surface and a first mirror for deflecting the reflection image of light from the original toward the predetermined direction and moves at the predetermined speed in a reciprocating manner in parallel with, whilst being kept a certain distance away from, the undersurface of original table 111.

Second scanner unit 114 has second and third mirrors which deflect the reflected light image from the original, deflected by first mirror of first scanner unit 113 toward the predetermined direction and moves in a reciprocating manner at a speed related to that of first scanner unit 113 and in parallel thereto. Optical lens 115 reduces the reflected light image from the original, thus deflected by third mirror of the second scanner unit, so that the reduced light image will be focused on the predetermined position on CCD line sensor 116.

CCD line sensor 116 implements sequential photoelectric conversion of the focused light image into electric signals and outputs them. CCD line sensor 116 is a three-line color CCD which reads monochrome or color images and outputs line data as to color separation components R(red), G(green) and B(blue). The original image information thus obtained in the electric signal form from this CCD line sensor 116 is further transferred to an after mentioned image processor where predetermined image data processes are performed.

Next, the configuration of image forming unit 210 and the configuration of the components related to image forming unit 210 will be described. Provided below image forming unit 210 is a paper feeding mechanism 211 which separates a sheet of paper (recording medium) P, one by one, from a stack of paper held in a paper tray and feeds it toward image forming unit 210. The paper P thus separated is delivered into image forming unit 210 with its timing controlled by a pair of registration rollers 212 located before image forming unit 210. The paper P with an image formed on its one side is conveyed and re-fed to image forming unit 210 in time with image forming of image forming unit 210.

Arranged under image forming unit 210 is a conveyer and transfer belt mechanism 213. A conveyer and transfer belt 216 of conveyer and transfer belt mechanism 213 is wound and tensioned between a driving roller 214 and an idle roller 215 so that the upper and lower parts of the belt extend approximately parallel to each other. The conveyer and transfer belt 216 electrostatically attracts paper P to itself to convey it. Further, a pattern image detecting unit is provided under and in proximity to conveyer and transfer belt 216. Arranged in the paper conveyance path, downstream of conveyer and transfer belt mechanism 213 is a fixing unit 217. This fixing unit 217 fixes the transferred toner image onto paper P. The paper P having passed through the nip between a pair of fixing rollers of fixing unit 217 passes through a conveyance direction switching gate 218 and is discharged by discharge rollers 219 to a paper output tray 220 attached to the outer wall of copier body 1.

This switching gate 218 selectively connects the conveyance path of paper P after fixing with either the path to discharge paper P to the outside of copier body 1 or the path to recirculate paper P toward image forming unit 210. The paper P which is designated to be conveyed again to image forming unit 210 by means of switching gate 218 is inverted by means of a switch-back conveyance path 221 and then re-fed to image forming unit 210.

Arranged above, and in proximity to, conveyer and transfer belt 216 in image forming unit 210 are the first image forming station Pa, the second image forming station Pb, the third image forming station Pc and the fourth image forming station Pd, in the above mentioned order from the upstream side of the paper conveyance path.

Conveyer and transfer belt 216 is frictionally driven by driving roller 214 in the direction indicated by arrow Z in FIG. 2, and carries paper P which is fed by paper feeding mechanism 211 as stated above and sequentially conveys it through image forming stations Pa to Pd.

All the image forming stations Pa to Pd are of a substantially identical configuration. Each image forming station Pa, Pb, Pc and Pd has a photoreceptor drum 222*a*, 222*b*, 222*c* and 222*d*, which is driven in the rotational direction indicated by arrow F in FIG. 2. Provided around each photoreceptor drum 222*a*–222*d*, are a primary charger 223*a*, 223*b*, 223*c* and 223*d* for uniformly charging photoreceptor drum 222*a*–222*d*, a developing unit 224*a*, 224*b*, 224*c* and 224*d* for developing the static latent image formed on photoreceptor drum 222*a*–222*d*, a transfer charger 225*a*, 225*b*, 225*c* and 225*d* for transferring the developed toner image on photoreceptor drum 222*a*–222*d* to paper P, and a cleaning unit 226*a*, 226*b*, 226*c* and 226*d* for removing the leftover toner from photoreceptor drum 222*a*–222*d*, in this order with respect to the rotational direction of each photoreceptor drum 222*a*–222*d*.

Arranged above photoreceptor drums 222*a*–222*d* are laser beam scanner units 227*a*, 227*b*, 227*c* and 227*d*, respectively. Each laser beam scanner unit 227*a*–227*d* includes: a semiconductor laser element (not shown) for emitting a spot beam modulated in accordance with the image data; a polygon mirror (deflecting device) 240 for deflecting the laser beam from the semiconductor laser element, in the main scan direction; an f-theta lens 241 for focusing the laser beam deflected by polygon mirror 240 onto the surface of photoreceptor drum 222*a*–222*d*; and mirrors 242 and 243.

The pixel signal corresponding to the black component image of a color original image is supplied to laser beam scanner unit 227*a*; the pixel signal corresponding to the cyan color component image of a color original image is supplied to laser beam scanner unit 227*b*; the pixel signal corresponding to the magenta color component image of a color original image is supplied to laser beam scanner unit 227*c*; and the pixel signal corresponding to the yellow color component image of a color original image is supplied to laser beam scanner unit 227*d*. In this arrangement, the static latent images corresponding to the color separations of the original image information are formed on photoreceptor drums 222*a* to 222*d*. Developing units 224*a*, 224*b*, 224*c* and 224*d* hold black toner, cyan color toner, magenta color toner and yellow color toner, respectively. The static latent image on photoreceptor drum 222*a*–222*d* is developed by the toner of a corresponding color. Thus, the color separations of the original image information are reproduced in image forming unit 210 as toner images of different colors.

Provided between the first image forming station Pa and paper feeding mechanism 211 is a paper-attraction charger 228, which electrifies the conveyer and transfer belt 216 surface so that paper P fed from paper feeding mechanism 211 can be conveyed without any slip or slide, whilst being reliably attracted to conveyer and transfer belt 216, from the first image forming station Pa to the fourth image forming station Pd.

An erasing device 229 is arranged approximately right above driving roller 214 located between the fourth image forming station Pd and fixing unit 217. Applied to this erasing device 229 is an alternating current for separating paper P electrostatically attracted to conveyer and transfer belt 216, from the belt.

In the thus configured digital color copier, cut-sheet type paper is used as paper P. When paper P is delivered from the paper feed cassette into the guide along the paper conveyance path of paper feeding mechanism 211, the leading edge of paper P is detected by a sensor (not shown), which outputs a detection signal, and based on the detection signal the paper is briefly stopped by a pair of registration rollers 212. Then, paper P is sent out in synchronization with image forming stations Pa to Pd, onto conveyer and transfer belt 216 that is rotating in the direction of arrow Z in FIG. 2. At this point, conveyer and transfer belt 216 has been charged in a predetermined manner by paper attraction charger 228 as stated above, so that paper P is stably fed and conveyed during its passage through all the image forming stations Pa to Pd.

In each image forming station Pa–Pd, the toner image of each color is formed so that the different color images are superimposed on the support surface of paper P which is conveyed whilst being electrostatically attracted by conveyer and transfer belt 216.

When transfer of the image formed by the fourth image forming station Pd is completed, paper P is separated by virtue of the erasing charger, continuously starting at its leading edge, from conveyer and transfer belt 216 and introduced into fixing unit 217. Finally, paper P having the toner image fixed thereon is discharged through the paper discharge port (not shown) onto paper output tray 220.

In the above description, the photoreceptors are exposed to scanning laser beams from laser beam scanner units 227*a*–227*d*, so that optical images are written onto the photoreceptors. However, instead of the laser beam scanner units, another optical writing system (LED head) made up of a light emitting diode array with a focusing lens array may be used. In this case, an LED head is smaller in size compared to the laser beam scanner unit and has no moving parts hence is silent. Therefore, this LED head can be preferably used for an image forming apparatus, such as a tandem type digital color copier, which needs multiple optical writing units.

Figure 3:
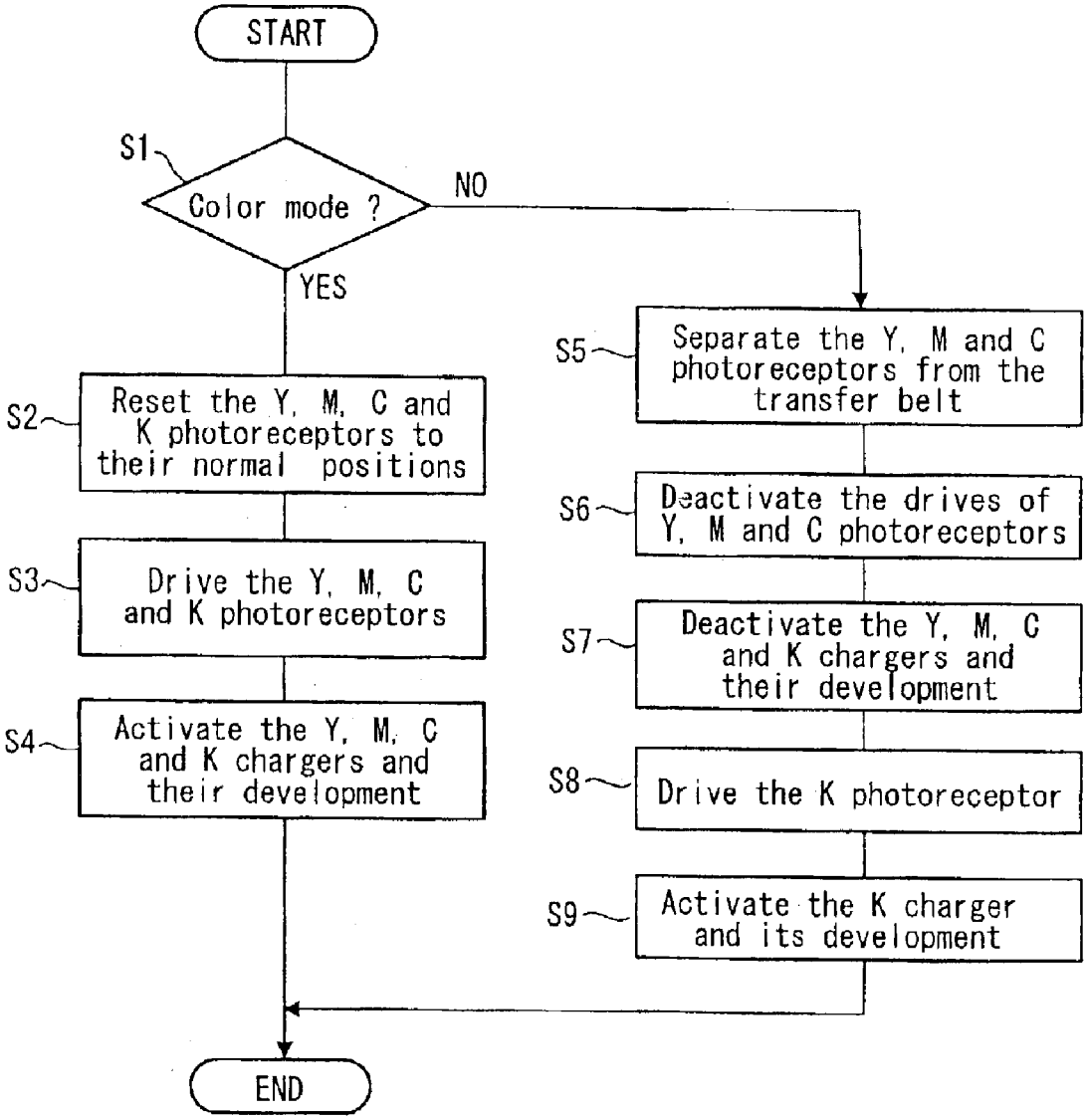
FIG. 3 is a flowchart showing the operational control in accordance with the output image mode designation.

In actual usage circumstances, such a color image forming apparatus is not only used for color printing but is often used for printing of monochrome (black and white) images. A typical operational control made in accordance with user mode selection will be described with reference to the flowchart shown in FIG. 3. First, when color image output mode is selected (Y at Step S1), all the photoreceptors 222*a*, 222*b*, 222*c* and 222*d* are set at the ordinary positions where they come in contact with conveyer and transfer belt 216 (S2). Then all the photoreceptors 222*a*, 222*b*, 222*c* and 222*d* are driven to rotate to implement charging, development and other necessary operations for each of the photoreceptors 222*a*, 222*b*, 222*c* and 222*d*, in accordance with the electrophotographic process (S3), whereby a color image is formed on a sheet of paper.

On the other hand, when black/white image output mode is selected (N at S1), a separation/abutment mechanism is actuated so that photoreceptors 222*b*, 222*c* and 222*d* for yellow (Y), magenta (M) and cyan (C) are separated from conveyer and transfer belt 216 (S5). Then, drives of these photoreceptors 222*b*, 222*c* and 222*d* are turned off to stop them rotating (S6). At the same time, charging, development and other necessary operations for these photoreceptors 222*b*, 222*c* and 222*d* are turned off (S7). In this condition, photoreceptor 222*a* for black development is driven to rotate (S8) to implement charging, development and other necessary operations for the photoreceptor 222*a* for black development, in accordance with the electrophotographic process (S9) to thereby produce a monochrome image with black toner on a sheet of paper.

In the above way, when the black/white image output mode is selected, photoreceptors 222*b*, 222*c* and 222*d*, other than photoreceptor 222*a* for black development, are set into a non-active state by stopping the rotation or in some other way and caused to part with transfer and conveyance belt 216. Accordingly, it is possible to reduce the risk of coating abrasion of photoreceptors 222*b*, 222*c* and 222*d* which are unused in the black/white image output mode, due to the cleaning blades and printing paper, transfer and conveyance belt 216, etc, to as low as possible.

Such an image forming apparatus usually has a storage means, so that it is possible to know in what ratio black/white and color copy operations are implemented in the image forming apparatus, or what sizes of copies are used. Statistical analysis of these pieces of data from the market makes it possible to evaluate the setting of the durable factor of the photoreceptor for black and the photoreceptors for other development colors, which will minimize the waste of replacement. From such evaluation of data, it was found to be preferred that the photoreceptors of the present application should satisfy the following relation:

$$0.5<(X/Y)<0.8,$$

where X represents the reduction in film thickness (Å) per $1\times10^7$ mm of the traveling distance of the photoreceptor for black development and Y represents the reduction in film thickness (Å) per $1\times10^7$ mm of the traveling distance of the photoreceptors for the other development colors.

Here, when (X/Y) is greater than 0.8, or the reduction of the photoreceptor for black in film thickness per unit traveling distance is greater, and beyond the predetermined range, the photoreceptor for black development will degrade earlier than the photoreceptors for the other development colors if the machine is used more often for black/white copying operations. If the machine is used without maintenance, it cannot keep good image quality because of color imbalances. However, replacement of only the photoreceptor for black development in this situation will also cause color imbalance, resulting in failure to maintain good image quality. Replacement of all the photoreceptors results in large wastefulness because the photoreceptors for the other development colors which are still usable must also be discarded.

When (X/Y) is smaller than 0.5, the photoreceptors for the other development colors will degrade earlier than the photoreceptor for black development if the machine is used more often for color copying operations. If the machine is used without maintenance, it cannot keep good image quality because of color imbalances. However, replacement of the photoreceptors for the other development colors in this situation will also cause color imbalance, resulting in failure to maintain good image quality. Replacement of all the photoreceptors results in large wastefulness because the photoreceptor for black development which is still usable must be discarded.

In the present invention, limiting these factors to the predetermined ranges makes it possible to meet the market demands of the great majority of users. Specific methods of limiting the abrasion characteristics of the photoreceptors within the predetermined ranges in the present invention can be mentioned as follows:

1. For the binder resin for the photoreceptor for black development, a binder resin with higher resistance to abrasion than that for the photoreceptors for the other development colors may be selected.

2. The usage ratio of the charge transport material for the binder resin used for the photoreceptor for black development may be adjusted to be lower than that for the photoreceptors for the other development colors (the proportion of the binder resin is made higher).
3. A low friction material such as polyvinylidene fluoride may be added to the photoreceptor for black development.

With these methods, the abrasion resistance of the photoreceptors can be adjusted. However, the present invention should not be limited to these.

(Embodiment)

Specific examples of the present invention will be described herein-below.

EXAMPLE 1

As a conductive substrate 1 shown in FIG. 1, an aluminum drum with 40 mm in diameter and 340 mm in length was used. Four parts by weight of titanium oxide particles and 6 parts by weight of a copolymer nylon resin (trade name: CM8000, a product of Toray Industries, Inc.) as a binder resin were added to a mixed solvent consisting of 35 parts by weight of methyl alcohol and 65 parts by weight of 1,2-dichloroethane. Then the mixed solvent was dispersed for eight hours using a paint shaker so as to prepare an undercoat layer application liquid. Then the thus obtained application liquid was charged into a tank. The aluminum drum was dipped into the liquid, forming an undercoat layer 5 of 0.9 μm thick on the aluminum drum. Since the solvent evaporates during drying, titanium oxide particles and copolymer nylon resin remain as the undercoat layer, which consists of 40 wt % titanium oxide particles and 60 wt % binder resin.

Figure 4:
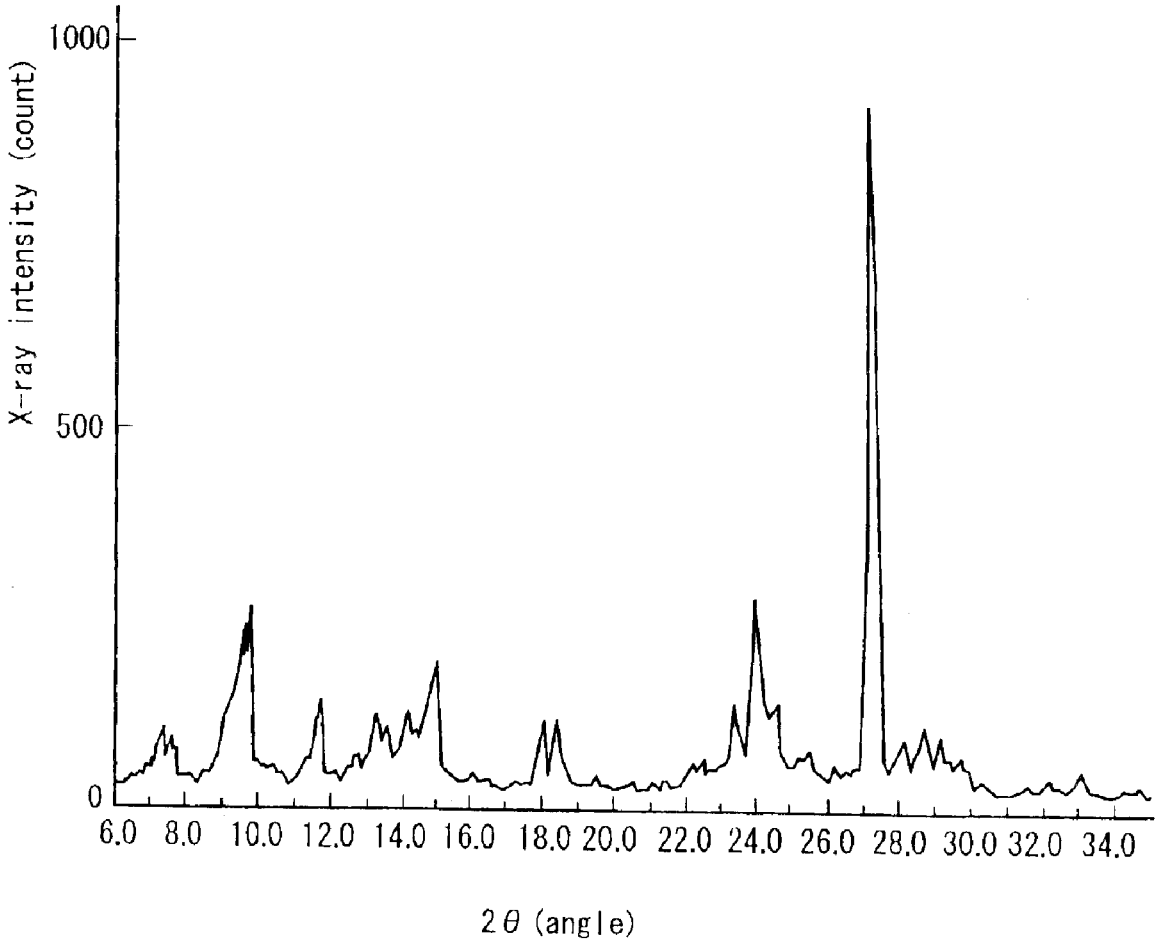
FIG. 4 is a CuK$\alpha$ characteristic X-ray diffraction chart of an oxotitanyl phthalocyanine pigment used in the embodiment of the present invention.

Subsequently, two parts of oxo-titanyl phthalocyanine pigments at least presenting a clear peak at a Bragg angle (2θ±0.2°) of 27.3° by CuKα characteristic X-ray diffraction shown in FIG. 4, one part of a polyvinyl butyral resin (trade name: S-LEC BMS, a product of SEKISUI CHEMICAL CO., LTD.) and 97 parts of dichloroethane were dispersed for 12 hours using a ball mill dispersing machine to prepare a dispersed liquid. The thus obtained liquid was charged into a tank, and the aluminum drum with undercoat layer 5 formed thereon was dip coated to form a charge generation layer 2 of about 0.2 μm thick over the undercoat layer.

Further, 100 parts by weight of a charge transport material: the aforementioned butadiene compound (the example compound (2-2)) and 140 parts by weight of a polycarbonate resin having the following constitutional formula (example compound (6)) as a binder resin, 5 parts by weight of 2,6-bis-tert-butyl-4 methyl phenol (Sumilizer BHT, a product of Sumitomo Chemical Co., Ltd.) as an antioxidant and 0.0001 part by weight of a silicone leveling agent (trade name: KF-96, a product of Shin-Etsu Chemical Co., Ltd.) were blended into 1200 parts by weight of tetrahydrofuran so as to prepare a coating liquid for charge transport layers.

(6)

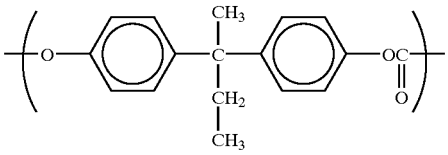

The thus prepared coating liquid for charge transport layers was dip coated over the charge generation layer formed as above. After drying for 1 hour at 120° C., a charge transport layer of about 20 μm thick was formed. Thus, a layered photoreceptor shown in FIG. 1 was prepared as a photoreceptor for black development.

Similarly, 100 parts by weight of a charge transport material: the aforementioned butadiene compound (the example compound (2-2)) and 140 parts by weight of a polycarbonate resin compound having the following constitutional formula (example compound (7): a copolymer containing three types of repeat units in a 0.0001:0.85:0.1499 mol ratio) as a binder resin, 5 parts by weight of 2,6-bis-tert-butyl-4 methylphenol (Sumilizer BHT, a product of Sumitomo Chemical Co., Ltd.) as an antioxidant and 0.0001 part by weight of a silicone leveling agent (trade name: KF-96, a product of Shin-Etsu Chemical Co., Ltd.) were blended into 1200 parts by weight of tetrahydrofuran so as to prepare a coating liquid for charge transport layers.

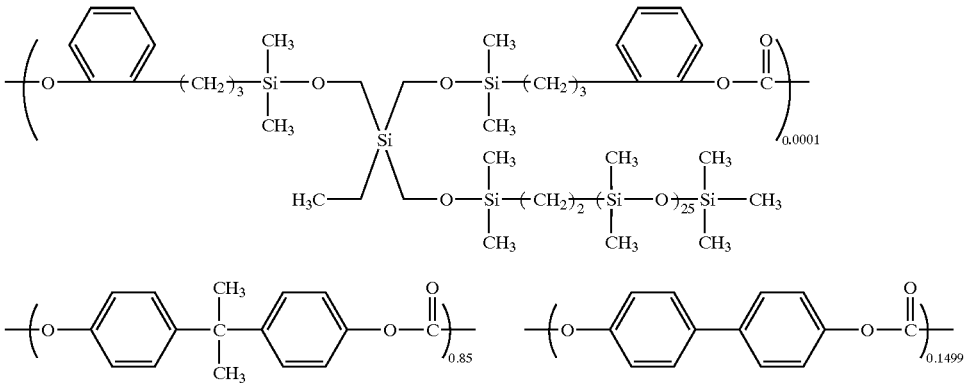

(7)

The thus prepared coating liquid for charge transport layers was dip coated over the charge generation layer formed as above. After drying for 1 hour at 120° C., a charge transport layer of about 20 μm thick was formed so as to be used for the photoreceptors for color development. Here, the amount of solvent was adjusted as appropriate, taking into consideration the viscosity and coatability.

The thus fabricated electrophotographic photoreceptors were set on a tandem type full-color copier (a modified AR-C150 (a product of Sharp Corporation) of which drum drive and transfer belt drive were permitted to be varied arbitrarily). The image characteristics and reduction in film thickness of each photoreceptor at the initial stage and after a copying operation of 40,000 sheets, specifically, 12,000 copies of a black/white original having 10% image density (with color drums stopped and kept away from the recording sheet transfer belt) and 28,000 copies of an original having 10% image density for each of K(BK), C, M and Y, were measured. In this operation, the traveling distance of the drum for black development was $4\times10^7$ mm, and the traveling distance of each color drum was $2.8\times10^7$ mm. The result is shown in Table 1 below.

EXAMPLE 2

Photoreceptors were prepared and evaluated in the same manner as in example 1, except that a polycarbonate resin having the following constructional formula (example compound (8)) was used as the binder resin for the photoreceptor for black development and the aforementioned example compound (1-1) (trade name: Z-400, a product of Mitsubishi Engineering plastics Co.) was used as the polycarbonate resin for the photoreceptors for colors. The result is shown in Table 1.

(8)

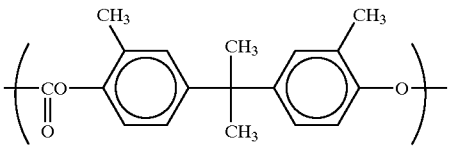

(1-1)

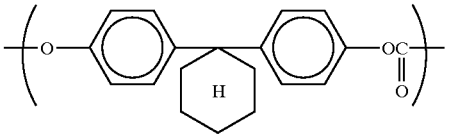

COMPARATIVE EXAMPLE 1

Photoreceptors were prepared and evaluated in the same manner as in example 1, except that the aforementioned example compound (6) (having the same composition as the polycarbonate resin used for the photoreceptor for black development) was used as the polycarbonate resin for the photoreceptors for colors. The result is shown in Table 1.

COMPARATIVE EXAMPLE 2

Photoreceptors were prepared and evaluated in the same manner as in example 1, except that a polyacrylate resin (trade name: U-100, a product of UNITIKA LTD.) was used for the polycarbonate resin used for the photoreceptors for colors, and dichloromethane was used as the solvent instead of tetrahydrofuran. The result is shown in Table 1.

EXAMPLE 3

The conductive substrate, undercoat layer and charge generation layer were formed in the same manner as in example 1. Then, 100 parts by weight of a charge transport material: the aforementioned example compound (2-2) and 160 parts by weight of the aforementioned copolymer resin (example compound (7)), 5 parts by weight of 2,6-bis-tert-butyl-4 methyl phenol (Sumilizer BHT, a product of Sumitomo Chemical Co., Ltd.) and 0.0001 part by weight of a silicone leveling agent (trade name: KF-96, a product of Shin-Etsu Chemical Co., Ltd.) were blended into 1200 parts by weight of tetrahydrofuran so as to prepare a coating liquid for charge transport layers. The thus prepared coating liquid for charge transport layers was dip coated over the charge generation layer 2 formed as above. After drying for 1 hour at 120° C., a charge transport layer 3 of about 20 μm thick was formed. Thus, a layered photoreceptor shown in FIG. 1 was prepared as a photoreceptor for black development.

Similarly, 100 parts by weight of a charge transport material: the aforementioned butadiene compound (the example compound (2-2)) and 160 parts by weight of the aforementioned polycarbonate resin (example compound (1-1), tradename: Z-400, a product of Mitsubishi Engineering plastics Co.), 5 parts by weight of 2,6-bis-tert-butyl-4 methyl phenol (Sumilizer BHT, a product of Sumitomo Chemical Co., Ltd.) and 0.0001 part by weight of a silicone leveling agent (trade name: KF-96, a product of Shin-Etsu Chemical Co., Ltd.) were blended into 1200 parts by weight of tetrahydrofuran so as to prepare a coating liquid for charge transport layers. The thus prepared coating liquid for charge transport layers was dip coated over the charge generation layer 2 formed as above. After drying for 1 hour at 120° C., a charge transport layer 3 of about 20 μm thick was formed so as to be used for the photoreceptors for color development. Here, the amount of solvent was adjusted as appropriate, taking into consideration the viscosity and coatability. The same evaluation as in example 1 was carried out. The result is shown in Table 1.

EXAMPLE 4

The conductive substrate, undercoat layer and charge generation layer were formed in the same manner as in example 1. Then, 100 parts by weight of a charge transport material: the aforementioned example compound (3-8), 160 parts by weight of the aforementioned polycarbonate resin (example compound (1-1), trade name: Z-400, a product of Mitsubishi Engineering Co.), 5 parts by weight of 2,6-bis-tert-butyl-4 methyl phenol (Sumilizer BHT, a product of Sumitomo Chemical Co., Ltd.) and 0.0001 part by weight of a silicone leveling agent (trade name: KF-96, a product of Shin-Etsu Chemical Co., Ltd.) were blended into 1200 parts by weight of tetrahydrofuran so as to prepare a coating liquid for charge transport layers. The thus prepared coating liquid for charge transport layers was dip coated over the charge generation layer formed as above. After drying for 1 hour at 120° C., a charge transport layer of about 23 μm thick was formed. Thus, a layered photoreceptor shown in FIG. 1 was prepared as a photoreceptor for black development.

Similarly, 100 parts by weight of a charge transport material: the aforementioned example compound (3-8) and 160 parts by weight of a polyacrylate resin (trade name: U-100, a product of UNITIKA LTD.), 5 parts by weight of 2,6-bis-tert-butyl-4 methyl phenol (Sumilizer BHT, a product of Sumitomo Chemical Co., Ltd.) and 0.0001 part by weight of a silicone leveling agent (trade name: KF-96, a product of Shin-Etsu Chemical Co., Ltd.) were blended into 1200 parts by weight of dichloromethane so as to prepare a coating liquid for charge transport layers. The thus prepared coating liquid for charge transport layers was dip coated over the charge generation layer formed as above. After drying for 1 hour at 120° C., a charge transport layer of about 23 μm thick was formed so as to complete a layered photoreceptor shown in FIG. 1, which was used for the photoreceptors for color development. Here, the amount of solvent was adjusted as appropriate, taking into consideration the viscosity and coatability. The same evaluation as in example 1 was carried out. The result is shown in Table 1.

EXAMPLE 5

Photoreceptors were prepared and evaluated in the same manner as in example 4, except that example compound (4-2) was used as the charge transport material and the drying temperature was set at 130° C. The result is shown in Table 1.

EXAMPLE 6

Photoreceptors were prepared and evaluated in the same manner as in example 4, except that a bisphenol-A polycarbonate (trade name: C-1400, a product of TEIJIN CO., LTD.) was used for the polycarbonate resin for the photoreceptors for colors. The result is shown in Table 1.

COMPARATIVE EXAMPLE 3

Photoreceptors were prepared and evaluated in the same manner as in example 3, except that a commercially available bisphenol-A polycarbonate (trade name: C-1400, a product of TEIJIN CO., LTD.) was used for both the polycarbonate resins for black and colors. The result is shown in Table 1.

COMPARATIVE EXAMPLE 4

Photoreceptors were prepared and evaluated in the same manner as in example 3, except that the drums for colors were neither stopped nor kept away from the recording sheet conveyer belt during the black and white image output mode. In this case, the traveling distances of the drums for black and colors were $4\times10^7$ mm. The result is shown in Table 1.

EXAMPLE 7

The conductive substrate, undercoat layer and charge generation layer were formed in the same manner as in example 1.

Then, 100 parts by weight of a charge transport material: the aforementioned example compound (2-2), 80 parts by weight of the aforementioned copolymer resin: the polycarbonate resin shown as example compound (6), 80 parts by weight of the aforementioned polycarbonate resin shown as example compound (1-1) (trade name: Z-200, a product of Mitsubishi Engineering plastics Co.), 5 parts by weight of 2,6-bis-tert-butyl-4 methyl phenol (Sumilizer BHT, a product of Sumitomo Chemical Co., Ltd.) and 0.0001 part by weight of a silicone leveling agent (trade name: KF-96, a product of Shin-Etsu Chemical Co., Ltd.) were blended into 1200 parts by weight of tetrahydrofuran so as to prepare a coating liquid for charge transport layers. The thus prepared coating liquid for charge transport layers was dip coated over the charge generation layer formed as above. After drying for 1 hour at 120° C., a charge transport layer of about 27 μm thick was formed. Thus, a layered photoreceptor shown in FIG. 1 was prepared so as to be used for the photoreceptor for black development.

Similarly, 100 parts by weight of a charge transport material: the aforementioned example compound (2-2), 80 parts by weight of the aforementioned copolymer resin: the polycarbonate resin shown as example compound (7), 80 parts by weight of the aforementioned polycarbonate resin shown as example compound (1-1) (trade name: Z-200, a product of Mitsubishi Engineering plastics Co.), 5 parts by weight of 2,6-bis-tert-butyl-4 methyl phenol (Sumilizer BHT, a product of Sumitomo Chemical Co., Ltd.) and 0.0001 part by weight of a silicone leveling agent (trade name: KF-96, a product of Shin-Etsu Chemical Co., Ltd.) were blended into 1200 parts by weight of tetrahydrofuran so as to prepare a coating liquid for charge transport layers. The thus prepared coating liquid for charge transport layers was dip coated over the charge generation layer formed as above. After drying for 1 hour at 120° C., a charge transport layer of about 27 μm thick was formed. Thus, a layered photoreceptor shown in FIG. 1 was prepared so as to be used for the photoreceptors for color development. Here, the amount of solvent was adjusted as appropriate, taking into consideration the viscosity and coatability. The same evaluation as in example 1 was carried out. The result is shown in Table 1.

EXAMPLE 8

Photoreceptors were prepared and evaluated in the same manner as in example 7, except that the thickness of the charge transport layer was changed to 23 μm. The result is shown in Table 1.

EXAMPLE 9

Photoreceptors were prepared and evaluated in the same manner as in example 7, except that the thickness of the charge transport layer was changed to 18 μm. The result is shown in Table 1.

REFERENCE EXAMPLE 1

Photoreceptors were prepared and evaluated in the same manner as in example 7, except that the thickness of the charge transport layer was changed to 32 μm. The result is shown in Table 1.

REFERENCE EXAMPLE 2

Photoreceptors were prepared and evaluated in the same manner as in example 7, except that the thickness of the charge transport layer was changed to 16 μm. The result is shown in Table 1.

TABLE 1

| | Film loss of BK drum (μm) | Film loss of Color drums (average μm) | X (Å) | Y (Å) | X/Y | Image of BK drum after 40 K pritns | Image of color after 40 K pritns |
|---|---|---|---|---|---|---|---|
| Ex. 1 | −7.7 | −7.5 | 183 | 268 | 0.68 | Good | Good |
| Ex. 2 | −8.1 | −7.9 | 203 | 282 | 0.72 | Good | Good |
| Ex. 3 | −6.2 | −6.3 | 155 | 225 | 0.69 | Good | Good |
| Ex. 4 | −8.8 | −9.5 | 220 | 339 | 0.65 | Good | Good |
| Ex. 5 | −8.0 | −8.7 | 200 | 311 | 0.64 | Good | Good |
| Ex. 6 | −8.8 | −10.4 | 220 | 371 | 0.59 | Good | Good |
| Ex. 7 | −7.0 | −7.0 | 170 | 250 | 0.68 | Good | Good |
| Ex. 8 | −7.0 | −7.1 | 170 | 254 | 0.67 | Good | Good |
| Ex. 9 | −7.0 | −7.0 | 170 | 250 | 0.68 | Good | Good |
| Comp. Ex. 1 | −7.3 | −5.0 | 183 | 179 | 1.02 | Imbalance in color | Imbalance in color |
| Comp. Ex. 2 | −7.3 | −10.9 | 183 | 389 | 0.47 | Imbalance in color | Imbalance in color |
| Comp. Ex. 3 | −13.5 | −10.4 | 338 | 371 | 0.91 | Fog, white stripes | Fog |
| Comp. Ex. 4 | −6.2 | −9.0 | 155 | 225 | 1.00 | Good | Filming |
| Refer. Ex. 1 | −7.5 | −7.7 | 188 | 275 | 0.68 | Image blur | Image blur |
| Refer. Ex. 2 | −7.5 | −7.5 | 188 | 268 | 0.70 | Low image, density, fog | Low image, density, fog |

Concerning the samples of comparative examples 1 and 2, a large difference in the reduced amount of film thickness between the drum for black development and the drums for color development occurred and the color balance after a 40K run degraded compared to the initial image. Also, it was impossible to match the end of life of all the four photoreceptors. With concern to the sample of comparative example 3, a marked reduction in film thickness occurred and image fog was observed after 25K prints. White stripes due to uneven reduction in film thickness, possibly caused by paper particles, occurred. As to the sample of comparative example 4, filming occurred on the color drums and image defects occurred with white and black stripes.

Since Reference examples 1 and 2 are a little infirm to the afore mentioned Examples, the preferable range of thickness of the photoreceptor layer is from 18 to 27 μm as shown in Reference Examples 1 and 2.

As to the sample of Reference example 5, serious image blur occurred from the beginning of the operation, resulting in markedly poor reproducibility of dots and lines.

Concerning to the sample of Reference example 6, no problems occurred at the initial stage. However, the charging characteristics became bad after 30K prints, causing density decrease and background fog.

Thus, in the present invention, differentiation of abrasion resistance between the photoreceptors for black development and for color development and limitation of the reduced amounts of the film thickness of the photoreceptive layer per unit traveling distance to the predetermined ranges make it possible to provide photoreceptors that satisfy both the durability and the electrophotographic performance. It is also possible to use all the photoreceptors and toners, for, and within, a concurrent period, and hence provide a low-cost color image forming apparatus.

In the present invention, since the photoreceptors for black and for colors are made to differ in the abrasion resistance and since the reduced amounts of the film thickness per unit traveling distance are designated to fall within the predetermined ranges, it is possible to use the drums for black and for color development for approximately the same period, without reaching a situation in which the drum for black development alone has been worn away and become unusable at an earlier time, or that the drum for black development alone has a long life because of marked abrasion resistance. Therefore, all the photoreceptors can be replaced at the same time, and it is possible to provide a low-cost color image forming apparatus.

What is claimed is:

1. A color image forming apparatus comprising a multiple number of electrophotographic image forming stations for multiple development colors including black, arranged in line in the paper feed direction, each image forming station having a photoreceptor, a charger, an exposure device, a developing device, a transfer device and a cleaning device, characterized in that the photoreceptors satisfy the following relation:

$$0.5<(X/Y)<0.8,$$

where X represents the reduction in film thickness (Å) per $1\times10^7$ mm of the traveling distance of the photoreceptor for black development and Y represents the reduction in film thickness (Å) per $1\times10^7$ mm of the traveling distance of the photoreceptors for the other development colors, and wherein the composition of the binder resin used in the photoreceptor for black development is different from one of the photoreceptors for the other development colors.

2. The color image forming apparatus according to claim 1, wherein the binder resin used for either the photoreceptor for black development or at least one of the photoreceptors for the other development colors employs a polycarbonate polymer having, at least, one structural unit represented by the following general formula (1):

(1)

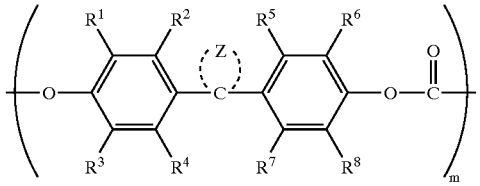

(wherein $R^1$, $R^2$, $R^3$, $R^4$, $R^5$, $R^6$, $R^7$ and $R^8$ individually represent a hydrogen atom, halogen atom, substituted or unsubstituted alkyl of 1 to 6 carbon atoms, $C_4$–$C_{10}$ cyclic hydrocarbon residual group, substituted or unsubstituted aryl, and Z represents a group of atoms required to constitute a substituted or unsubstituted carbocycle or substituted or unsubstituted heterocycle, m being an integer).

3. The color image forming apparatus according to claim 2, wherein the binder resin used for either the photoreceptor for black development or the photoreceptors for the other development colors employs a polycarbonate polymer having, at least, one structural unit represented by the general formula (1).

4. The color image forming apparatus according to claim 1, wherein the photoreceptors other than that for black development are stopped operating in monochrome (black and white) copy mode.

5. The color image forming apparatus according to claim 2, wherein the photoreceptors other than that for black development are stopped operating in monochrome (black and white) copy mode.

6. The color image forming apparatus according to claim 1, wherein the photoreceptors other than that for black development are separated from the paper feed line, in monochrome (black and white) copy mode.

7. The color image forming apparatus according to claim 2, wherein the photoreceptors other than that for black development are separated from the recording media conveyer belt, in monochrome (black and white) copy mode.

8. The color image forming apparatus according to claim 1, wherein the film thickness of the photoreceptor layer ranges from 18 μm to 27 μm.

9. The color image forming apparatus according to claim 2, wherein the film thickness of the photoreceptor layer ranges from 18 μm to 27 μm.

10. The color image forming apparatus according to claim 4, wherein the film thickness of the photoreceptor layer ranges from 18 μm to 27 μm.

11. The color image forming apparatus according to claim 5, wherein the film thickness of the photoreceptor layer ranges from 18 μm to 27 μm.

12. The color image forming apparatus according to any one of claims 1 through 11, wherein the shape and/or appearance of the photoreceptor for black development or its part is made different from the shape and/or appearance of the photoreceptors or their parts for the other development colors.

* * * * *